US006000867A

United States Patent [19]

Yoshii et al.

[11] Patent Number: 6,000,867

[45] **Date of Patent: *Dec. 14, 1999**

[54] PORTABLE IMAGE PROCESSING DEVICE

[75] Inventors: Shoji Yoshii, Kanagawa; Masahiro Nagakubo, Saitama, both of Japan

[73] Assignee: Sony Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,834

[22] Filed: Sep. 17, 1997

[30] Foreign Application Priority Data

Sep. 19, 1996 [JP] Japan ..... 8-247422

[51] Int. Cl.[6] ..... B41J 3/60

[52] U.S. Cl. ..... 400/188; 400/642; 271/186

[58] Field of Search ..... 400/88, 188, 608.3, 400/625, 628, 636, 636.2, 642, 643; 347/103, 109; 271/65, 186, 225, 303, 304, 902

[56] References Cited

U.S. PATENT DOCUMENTS

| | | | |
|---|---|---|---|
| 4,498,795 | 2/1985 | Tatara | 400/637.1 |
| 4,623,900 | 11/1986 | Watanabe | 400/188 |
| 4,786,789 | 11/1988 | Gaucher | 400/188 |
| 4,808,063 | 2/1989 | Moriguchi et al. | 358/75 |
| 5,172,988 | 12/1992 | Ledley et al. | 400/320 |
| 5,297,878 | 3/1994 | Saito et al. | 400/120.02 |
| 5,333,057 | 7/1994 | Morikawa et al. | 358/296 |
| 5,449,164 | 9/1995 | Quesnel et al. | 271/902 |
| 5,503,483 | 4/1996 | Petteruti et al. | 400/621 |

*Primary Examiner*—Ren Yan

*Attorney, Agent, or Firm*—Rader, Fishman & Grauer; Ronald P. Kananen

[57] ABSTRACT

In order to provide a lightweight, low-cost portable image processing device capable of reading the front and reverse side of a manuscript or printing on the front and reverse side of paper in one loading there is provided one or more read heads and/or print heads, one or more platen rollers and a guide mechanism for guiding paper in a forward direction. Here, images on both reverse and front surfaces of loaded paper can be automatically read out with one loading by the front or reverse of the loaded paper coming into contact with the surface of the platen roller rotated in a fixed direction so as to be moved in one direction, an image of the front or reverse of the paper being read out and, after the paper has been temporarily removed from the platen roller due to movement, the paper being returned in the opposite direction so that the front or reverse of the paper again comes into contact with the surface of the platen roller so as to be moved again in the one direction in such a manner that an image on the reverse or the front of the paper is read out.

16 Claims, 9 Drawing Sheets

PORTABLE IMAGE PROCESSING DEVICE

BACKGROUND OF THE INVENTION

The present invention relates to a portable image processing device and more particularly relates to a portable image processing device which incorporates therein a compact printer and/or a compact scanner and which is compatible with mobile computing.

Conventionally, it is well known that peripheral computer equipment such as printers and scanners that are housed in a single container as image processing devices have remained relatively unchanged. These devices have both printing and capturing functions and are also capable of copying. Similarly, conventional FAX devices that are one kind of image processing device and which also have a copying function are common.

In conventional image processing devices equipped with printers and scanners, image reading drive mechanisms and printing drive mechanisms are provided separately in order to combine the copying functions.

That is, a roller and mechanism dedicated to feeding a manuscript and a manuscript feed motor etc. are provided. Further, a paper feed rollers and mechanism together with a paper feed motor etc. are also provided as mechanisms for feeding paper to be printed.

In the case of such a structure, when a manuscript is loaded, the dedicated manuscript feed mechanism operates to start reading the manuscript and the dedicated paper feed mechanism operates and starts printing after a slight time lag so that a copying operation is executed almost simultaneously.

A large amount of electrical power is required by the device of the above configuration because the manuscript feed mechanism and the paper feed mechanism start to operate almost simultaneously. This means that batteries of a large capacity are required for this configuration to be put to portable use so that this is an inappropriate configuration for a portable image processing device.

The problem here, however, is not just one of power consumption. As two systems for independent feed mechanisms are provided in this configuration, the number of parts increases and the device becomes heavy which both makes portability difficult and causes device cost to rise.

It is also difficult to connect this device with external information equipment such as personal computers which brings few benefits with regards to use.

In addition to the above problem of unsuitability to mobile computing, the conventional mechanism has, despite its heavily equipped structure, had the disadvantage that the reading of the front and reverse sides of one sheet of manuscript or the printing of the front and reverse sides of one sheet of paper cannot be achieved with just one time loading (one pass) but rather two time loadings (two passes) where the upper surface of the paper is reversed and loaded into the device again have to be carried out.

As the present invention sets out to resolve the problems encountered in the related art, it is the object of the present invention to provide a low cost portable image processing device equipped with a copying function that can easily be connected with external information equipment, can read the front and reverse of a manuscript or print on the front and reverse of paper with just one loading of the paper (one pass), which is lightweight, and which is compatible with mobile computing.

SUMMARY OF THE INVENTION

In order to resolve the aforementioned problems, a portable image processing device according to the present invention comprises at least one read head, at least one platen roller and a guide mechanism for guiding paper in a direction of progression. Here, images on both reverse and front surfaces of loaded paper can be automatically read out with one loading by the front or reverse of the loaded paper coming into contact with the surface of the platen roller rotated in a fixed direction so as to be moved in one direction, an image of the front or reverse of the paper being read out and, after the paper has been temporarily removed from the platen roller due to controlled movement, the paper being returned in the opposite direction so that the front or reverse of the paper again comes into contact with the surface of the platen roller so as to be moved again in the one direction in such a manner that an image on the reverse or the front of the paper is read out.

Alternatively, the portable image processing device according to the present invention comprises at least one print head, at least one platen roller, and a guide mechanism for guiding paper in a direction of progression. Here, images on both reverse and front surfaces of loaded paper can be automatically printed with one loading by the front or reverse of the loaded paper coming into contact with the surface of the platen roller rotated in a fixed direction so as to be moved in one direction, the front or reverse of the paper being printed on and, after the paper has been temporarily removed from the platen roller due to controlled movement, the paper being returned in the opposite direction so that the front or reverse of the paper again comes into contact with the surface of the platen roller so as to be moved again in the one direction in such a manner that the reverse or the front of the paper is printed on.

Further, the portable image processing device according to the present invention can comprise at least one read head, at least one print head, at least one platen roller and a guide mechanism for guiding paper in a direction of progression of the paper. Here, images on both reverse and front surfaces of loaded paper can be automatically read out and/or printed with one loading by the front or reverse of the loaded paper coming into contact with the surface of the platen roller rotated in a fixed direction so as to be moved in one direction, an image of the front or reverse of the paper being read out and/or the front or reverse of the paper being printed on and, after the paper has been temporarily removed from the platen roller due to controlled movement, the paper being returned in the opposite direction so that the front or reverse of the paper again comes into contact with the surface of the platen roller so as to be moved again in the one direction in such a manner that an image on the reverse or the front of the paper is read and/or the reverse or the front of the paper is printed on.

According to the above configuration, a portable image processing device for inputting and outputting images can have just one paper feed mechanism, can have fewer parts, consume less power, be compact and lightweight and be easy to transport.

Further, when the portable image processing device according to the present invention is provided with a front/reverse read-out means having a function for carrying out up and down or front to back reverse processing on a read-out image, read data processing at the time of reading of the front or reverse of a manuscript can be performed in a more effective manner.

Moreover, when the portable image processing device according to the present invention is provided with front/reverse printing means having a function for carrying out up and down or front to back reverse processing on a printed image, print data processing at the time of printing to the front and reverse of printing paper can be performed in a more efficient manner.

Further, when the front/reverse read-out means and front/reverse printing means of the portable image processing device according to the present invention are combined, data can be processed in a more efficient manner during capturing the front and reverse surfaces of a manuscript or during printing to the front and/or reverse sides of paper.

Moreover, when the portable image processing device according to the present invention is provided with color image processing means having a color image signal processing function, inputting or outputting of color images becomes possible so as to broaden the range of possible applications.

Still further, when the portable image processing device according to the present invention is further provided with binarizing/gradation processing means having both binarizing and gradation signal processing functions, application to the processing of binary information and the processing of information such as photographs that have a great deal of gradation becomes possible.

Moreover, when the portable image processing device according to the present invention is provided with camera input signal processing means for processing image signals from a camera, images taken on sight can be directly inputted and processed.

When the portable image processing device according to the present invention is further provided with external information equipment communication management means for communicating and exchanging data with external information equipment, connection with external equipment is simple and efficient.

Further, when the portable image processing device according to the present invention is further provided with infrared signal input/output means capable of cordless connection to external equipment, the exchange of data with external equipment in a cordless and efficient manner is possible.

Moreover, when the portable image processing device according to the present invention is made to have a PHS circuit built-in, exchange of wireless image data is possible in a wireless manner and the range of applications is broadened.

When the portable image processing device according to the present invention is further provided with a TV/CATV tuner circuit, printing directly from TV/CATV programs is possible, as is dual side printing.

Further, when the portable image processing device according to the present invention is further provided with an auto feed mechanism, auto-feeding of manuscripts or paper is possible.

DETAILED DESCRIPTION OF THE PREFERRED EMBODIMENTS

First Embodiment

The following is a description of the first embodiment of the present invention.

Figure 1:
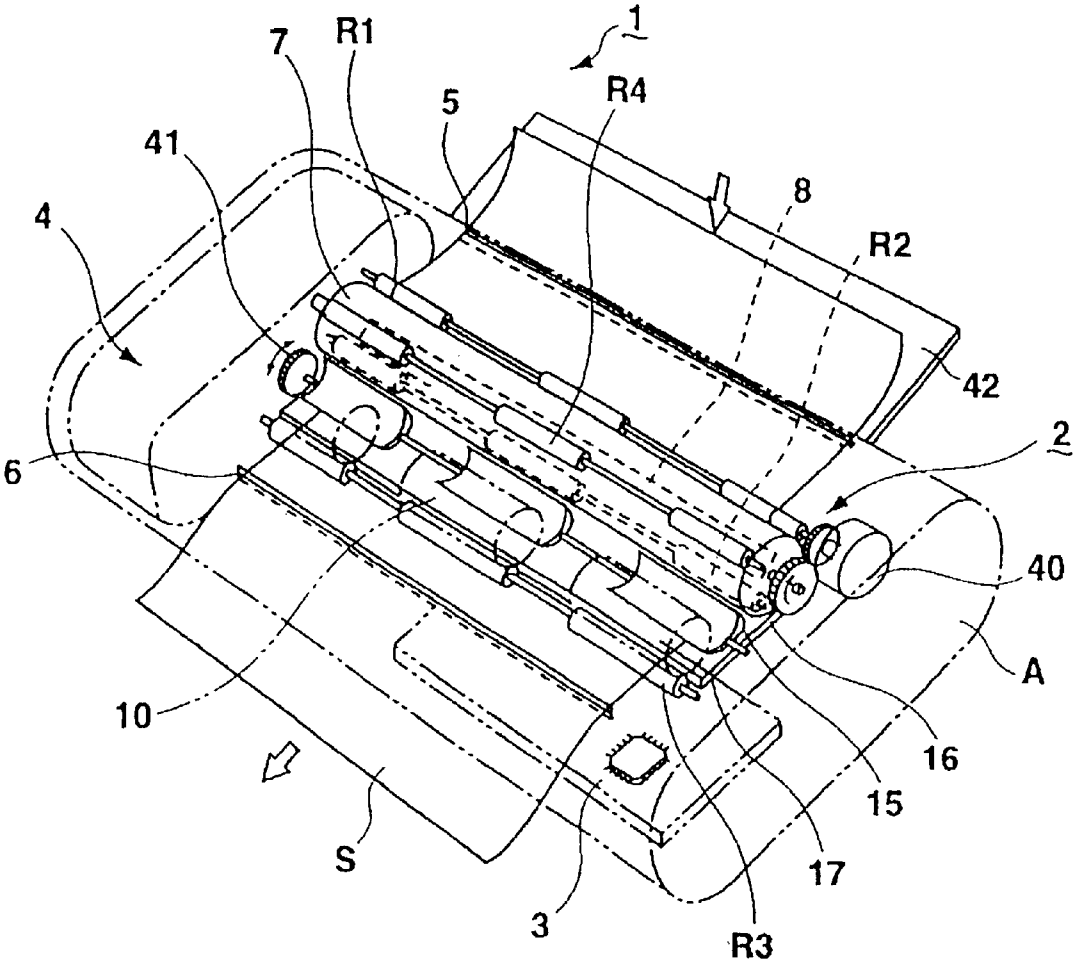
FIG. 1 is a perspective view of a first embodiment of a portable image processing device according to the present invention.
Figure 2:
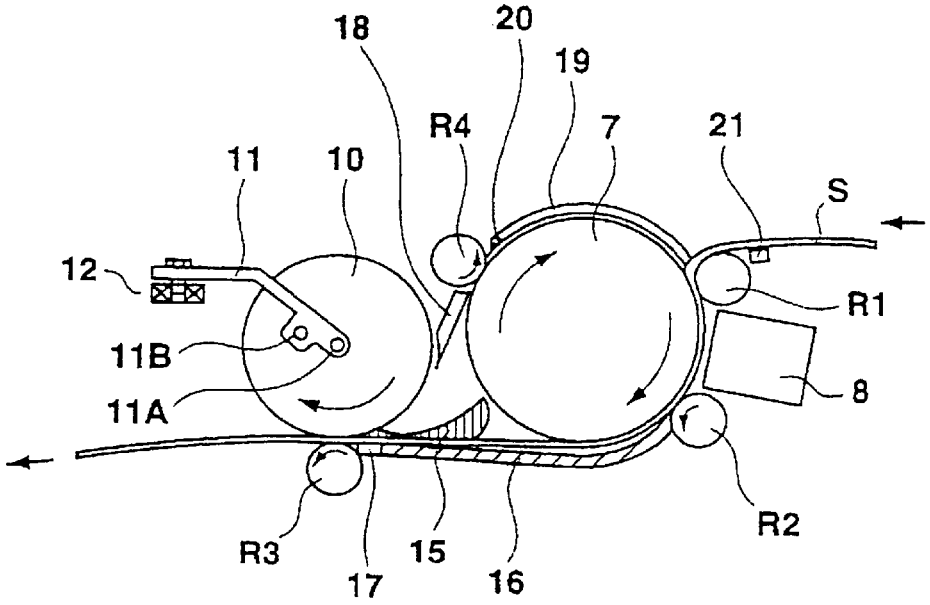
FIG. 2 is a side view of the essential parts of the configuration of the device shown in FIG. 1.

FIG. 1 is a perspective view of the first embodiment of a portable image processing device according to the present invention and FIG. 2 is a side view of the essential parts of the mechanism of the device shown in FIG. 1.

As shown in FIG. 1 and FIG. 2, a portable image processing device 1 of the present invention comprises a mechanism 2 provided within a small case A that can be carried about for feeding paper, a control part 3 equipped with for providing overall control of the device and which is equipped with various means and various circuits for executing various functions to be described later and a power supply 4.

Manuscript or printing paper S is loaded via a paper supply inlet 5 provided at the upper right end of the case A as shown in FIG. 2 and the paper S is then issued from a paper outlet 6.

Within the case A there is provided, in the direction of progression of the paper S, a third sensor 21 for detecting loading of paper S, a platen roller 7 rotatably driven by a spindle motor 40 rotated in one direction (the clockwise direction in FIG. 2) so that the loaded paper S becomes wrapper around, a pick-up roller R1, with the paper S becoming pinched between this pick-up roller R1 and the platen roller 7, a scanner/printer head (input/output head) 8 for coming near to or coming into contact with the paper S wrapped around the platen roller 7 so as to read out or print images, a first pinch roller R2, between which and the platen roller 7 the paper S is pinched so as to be fed, a guide plate 16 for guiding in the direction of progression of the paper, a guide mechanism 15 for controlling the direction of progression of the paper S and a first sensor 17 for detecting passage of the leading end of the paper S.

Further, following the first sensor 17, there is provided in a fixed position a second pinch roller R3 for pinching and feeding the paper S, a paper extraction roller 10 capable of being moved up and down and coming into contact with the second pinch roller R3 at the time of movement in a downward direction, a guide plate 18 positioned between the paper extraction roller 10 and the platen roller 7 for guiding paper S of the return direction towards the top of the platen roller 7, a third pinch roller R4 for pinching return direction paper S towards the top of the pinch roller 7, a second sensor 20 provided in the vicinity of the third pinch roller R4 for detecting passage of return direction paper S and a guide chute 19 for guiding progression of the paper S along the upper direction of the platen roller 7 until the pick-up roller R1 is reached from the second sensor 20.

Figure 3:
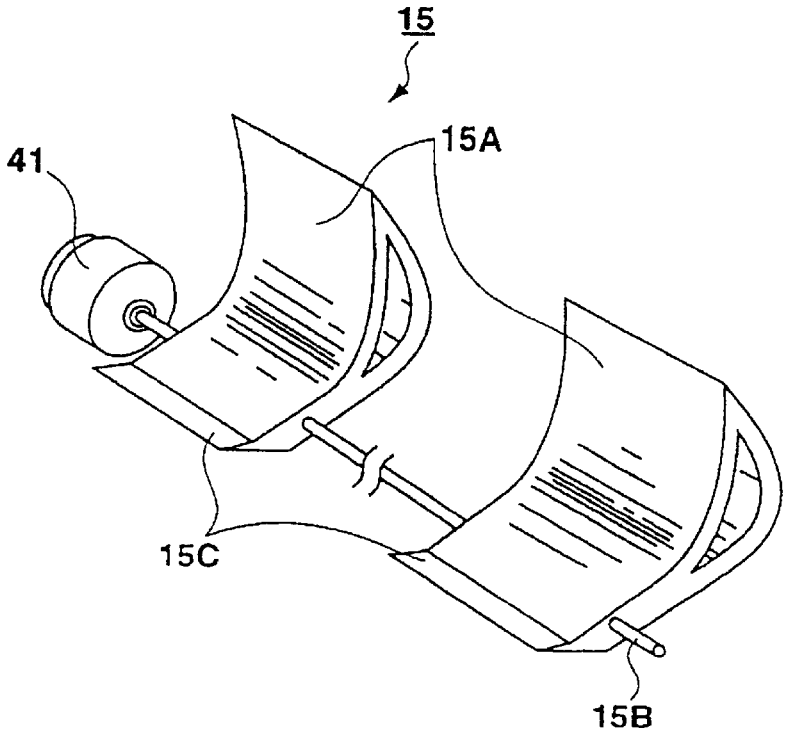
FIG. 3 is a perspective view of the guide mechanism shown in FIG. 1.
Figure 4:
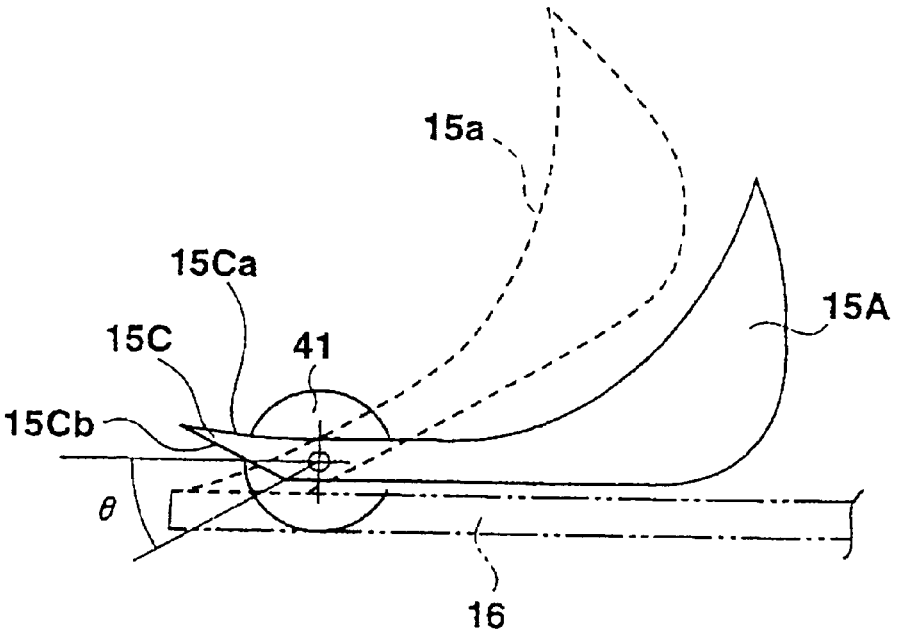
FIG. 4 is a view illustrating the operation of the guide mechanism shown in FIG. 3.

FIG. 3 is a perspective view of the guide mechanism shown in FIG. 1, and FIG. 4 is a view illustrating the guide mechanism shown in FIG. 3. When the configuration and operation of the guide mechanism 15 is described based on FIG. 3 and FIG. 4, a plurality of L shaped guide pieces 15A are coupled to a rotatably fixed axis 15B near the end of the L shape, with the axis 15B in turn being coupled to a rotary solenoid 41. The rotary solenoid 41 can be rotated in the clockwise direction or the anti-clockwise direction by just a prescribed angle θ, with each guide piece 15A also being rotated by a prescribed angle θ in the clockwise and anti-clockwise directions about the axis 15B as a result of this rotation.

The lower end surfaces of the guide pieces 15A are flat, with the end parts 15C into which the axis 15B is inserted forming a sharp point having an acute angle made by the lower end of a surface 15C*b* and the upper end surface 15C*a* with a smoothly sloping guide surface 15*a* then being formed from the upper side of this end part to the L-shaped rising end at that is the remaining end.

As shown in FIG. 4, the guide pieces 15A are arranged slightly towards the upper side of the guide plate 16. When the paper S is then moved from the right side to the left side on the guide plate 16 in FIG. 4, the guide pieces 15A are at the position shown by the solid line in FIG. 4. Therefore, as shown in FIG. 4, the paper S is guided to the space above the guide plate 16 and below the lower ends of the guide pieces 15A so as to be smoothly moved towards the left-hand side.

Conversely, when the paper moves in the return direction (from the left side to the right side in the drawings), the guide pieces 15A rotate to the position shown by the dotted line within FIG. 4. The lower side surface 15C*b* then comes into contact with the upper surface of the guide plate 16 and the entrance to the opening becomes closed.

Return direction paper S is therefore moved towards the right side along the upper side surface 15C*a* of the guide piece 15A and then proceeds in the upper direction along the guide surface 15*a*.

Figure 5:
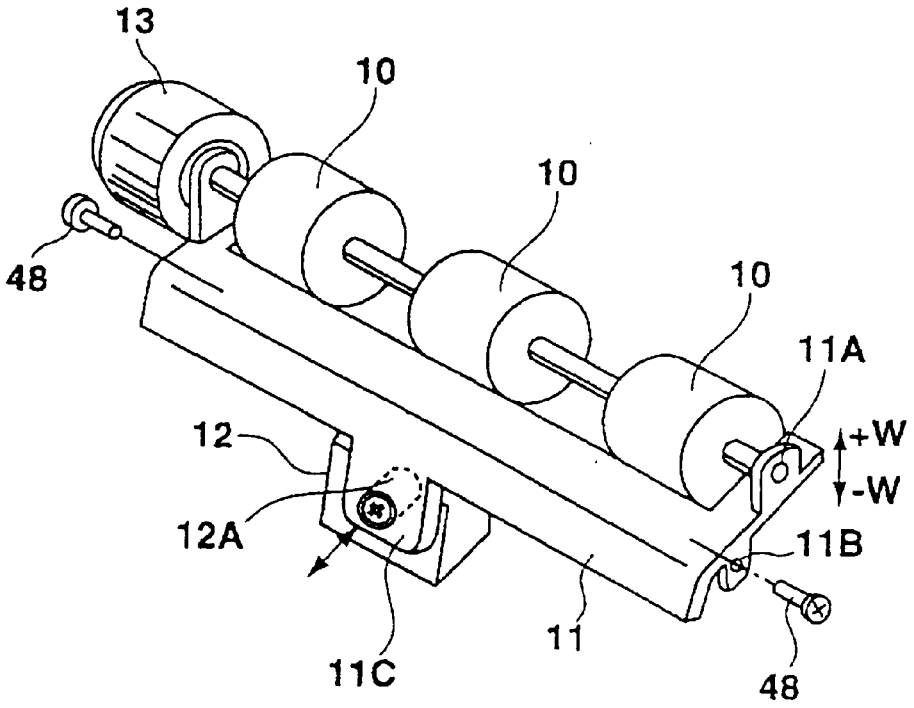
FIG. 5 is a perspective view of a paper extraction roller and peripheral parts thereof.

FIG. 5 shows a perspective view of the paper extraction roller 10 and the surrounding parts. The configuration and operation of the paper extraction roller 10 and the driving mechanism will now be described based on FIG. 5. A plurality of paper extraction rollers 10 are coupled to the axis of a paper extraction motor 13 so as to be rotated in a clockwise or anti-clockwise direction. The axis of the paper extraction motor 13 is inlaid into a first pinhole 11A provided at an end of a plate-shaped frame 11 of a side surface shape that is in the shape of an inverted V so that the paper extraction motor 13 is fixed to the frame 11.

A projection 11C is then provided at the other end of the frame 11, with a second pin hole 11B for axially supporting the whole of the frame 11 using a pin 48 then being provided at the approximate center of the projection 11C and the first pinhole 11A. Further, a plunger 12A driven backwards and forwards by a solenoid plunger 12 arranged at a fixed position is attached to the projection 11C.

As a result of this configuration, when the plunger 12A is driven backwards and forwards, the projection 11C is also moved backwards and forwards so that the frame 11 fluctuates at the center of the pin 48 and the second pin hole 11B. As a result of this, the paper extraction roller 10 moves by +W or −W in FIG. 5 together with the paper extraction motor 13.

As a result of this movement, as shown in FIG. 2, when the paper extraction roller 10 moves in the −W direction, the paper extraction roller 10 comes into contact with the second pinch roller R3 and the paper is pressed, and when the paper extraction roller 10 moves in the +W direction, the paper extraction roller 10 leaves away from the second pinch roller R3 and the paper is released.

Next, a description will be given of the essential parts of the configuration of the portable image processing device 1 by referring to FIG. 6 to FIG. 12. In FIG. 6 to FIG. 12, an image configuration capable of reading in a document having images on both sides is adopted, with numeral 8 representing the scanner head of this configuration.

Figure 6:
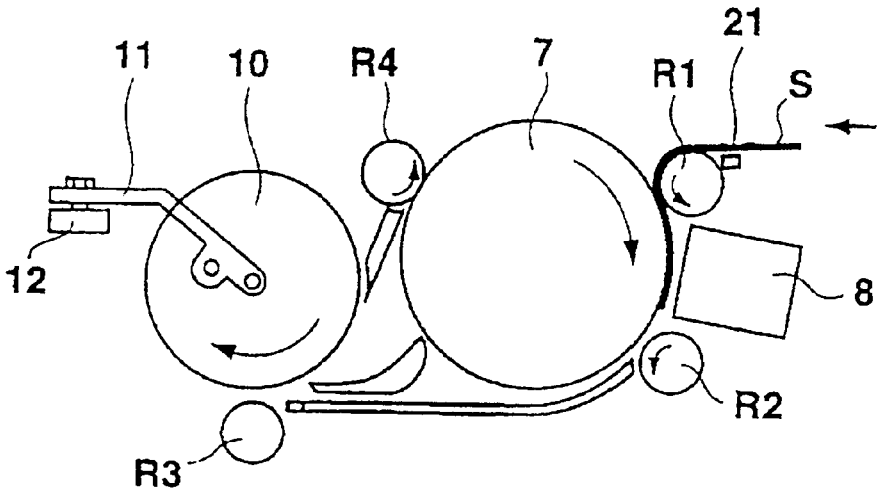
FIG. 6 is a view illustrating the operation of the essential parts of the configuration of the portable image processing device according to the present invention.

In FIG. 6, when the paper S is loaded so as to be reversed, the third sensor 21 detects the loading of the paper S. The reverse-loaded paper S then becomes sandwiched between the pick-up roller R1 rotated in the anti-clockwise direction and the platen roller 7 rotated in the clockwise direction so that the reverse surface of the paper comes into contact with the surface of the platen roller 7 50 as to be wrapped around the platen roller 7 and proceed in a clockwise direction. The scanner/printer head 8 then reads in the image that is on the other or obverse surface of the paper S.

Figure 7:
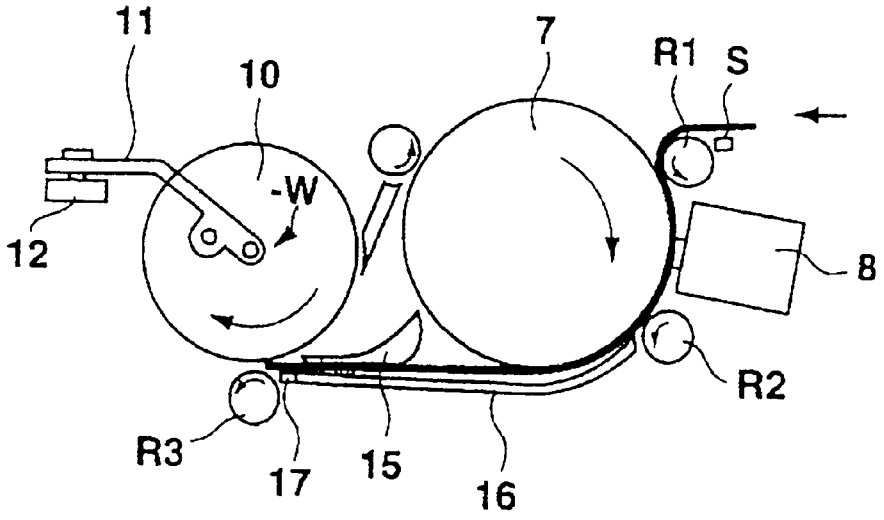
FIG. 7 is a view illustrating the operation of the essential parts of the configuration of the portable image processing device according to the present invention continuing on from FIG. 6.

In FIG. 7, the paper S is sandwiched by the first pinch roller R2 and the platen roller 7 that is rotating in an anti-clockwise direction so as to be made to proceed forward to the space formed by the guide plate 16 and the lower end surface of the guide mechanism 15. During this time, the scanner/printer head 8 continues to read out in the image drawn on the front surface of the paper S.

When the end of the paper S is detected by the first sensor 17 this acts as a trigger for the operation of opening the paper extraction motor 13, this is shifted in the direction of −W in FIG. 7 and the paper extraction roller 10 that then comes into contact with the second pinch roller R3 is caused to rotate in the clockwise direction. At the same time the second pinch roller R3 is made to rotate in an anti-clockwise direction so that the paper S is sandwiched between the paper extraction roller 10 and the second pinch roller R3 so as to move in the left direction at the center of FIG. 7.

Figure 8:
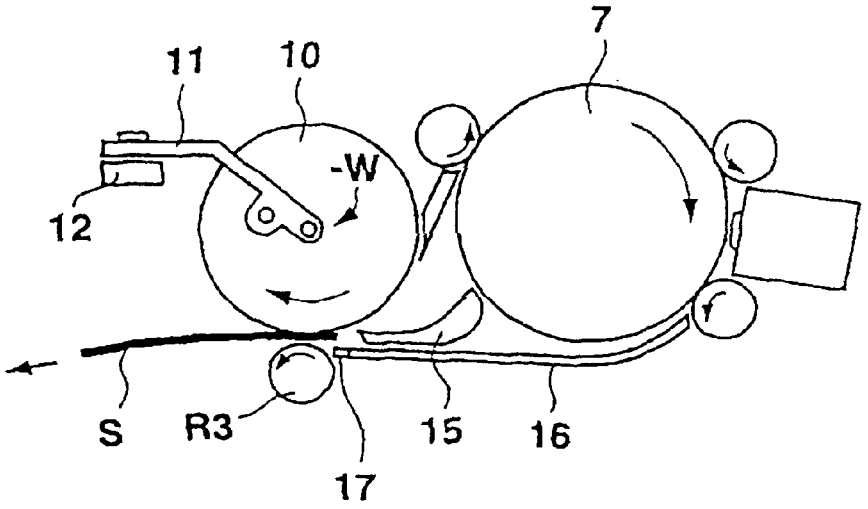
FIG. 8 is a view illustrating the operation of the essential parts of the configuration of the portable image processing device according to the present invention continuing on from FIG. 7.

Further, as shown in FIG. 8, the paper is moved in the left direction, image capture for the front surface of the paper S by the scanner/printer head 8 is finished and detection of the following end of the paper S by the first sensor 17 is reached.

Figure 9:
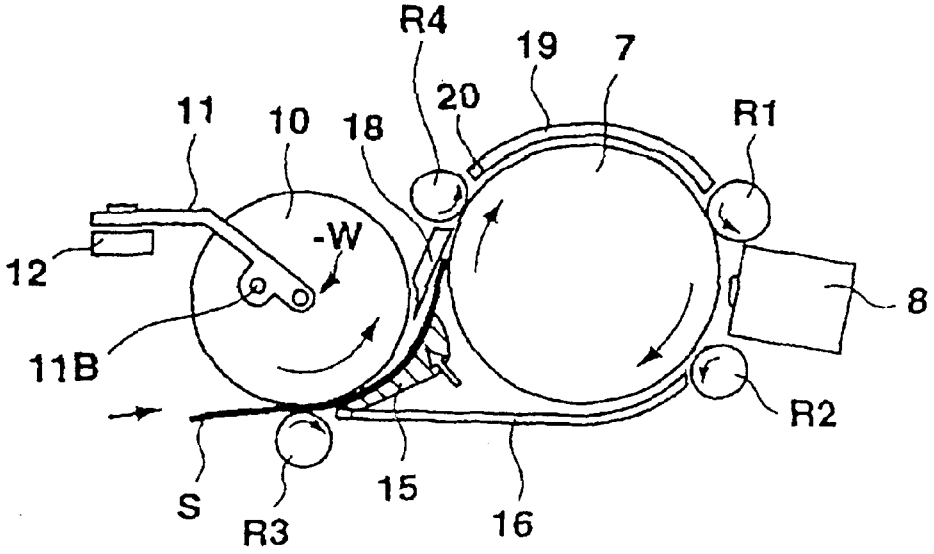
FIG. 9 is a view illustrating the operation of the essential parts of the configuration of the portable image processing device according to the present invention continuing on from FIG. 8.

When the rear end of the paper S is detected by the first sensor 17, this acts as a trigger as shown in FIG. 9 for the rotation of the guide mechanism 15 as described in FIG. 4 so that the space formed by the guide plate 16 and the lower end surface of the guide mechanism 15 is closed. Reverse rotation of the paper extraction motor 13 then starts, there is shifting of −W as shown in FIG. 9 and the paper extraction roller 10 in contact with the second pinch roller R3 is made to rotate in an anti-clockwise direction. At the same time the second pinch roller R3 is made to rotate in a clockwise direction so that the paper S is sandwiched between the paper extraction roller 10 and the second pinch roller R3 so that the paper moves so as to start returning in the right direction in FIG. 9. The returning paper S then goes upwards along the guide surface 15*a* of the guide mechanism 15 and the guide plate 18.

When the following end of the returning paper S reaches the upper part of the platen roller 7, contrary to that above, the reverse surface of the paper S comes into contact with the upper surface of the platen roller 7 so as to be wrapped around and then proceed in a clockwise direction.

Figure 10:
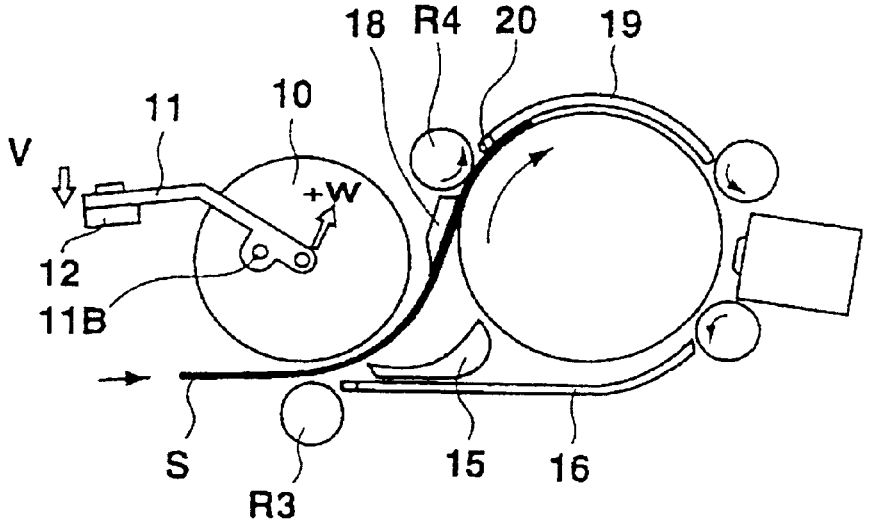
FIG. 10 is a view illustrating the operation of the essential parts of the configuration of the portable image processing device according to the present invention continuing on from FIG. 9.

In FIG. 10, the following end of the returning paper S is sandwiched by the third pinch roller R4 and the platen roller 7, i.e. the paper S is made to proceed in the return direction by the third pinch roller R4 and the platen roller 7. In this way, when the following end of the paper S proceeding in the return direction is detected by the second sensor 20, this first acts as a trigger so that the plunger 12A is driven in a direction V shown in FIG. 10 by the solenoid plunger 12. The frame 11 then fluctuates taking the second pin hole 11B as center, the paper extraction roller 10 is moved in the direction +W in FIG. 10 together with the paper extraction motor 13, while at the same time rotation of the paper extraction motor 13 is halted.

As a result of this movement, as shown in FIG. 10, the paper extraction roller 10 is brought away from the second pinch roller R3 and the paper is released.

The guide mechanism 15 is then returned to rotating in the reverse direction as described in FIG. 4 and a space is again formed between the guide plate 16 and the lower end surface of the guide mechanism 15.

The paper S then continues to be made to proceed in the return direction by the third pinch roller R4 and the platen roller 7 so as to move through the guide chute 19. The paper S then proceed in a clockwise direction together with the rotation of the platen roller 7 and so as to reach the pick-up roller R1.

In FIG. 11, the paper S is again sandwiched between the pick-up roller R1 rotating in an anti-clockwise direction and the platen roller 7 rotating in the clockwise direction. However, contrary to the previous time, on this occasion the top surface of the paper S comes into contact with the surface of the platen roller 7 so as to become wrapped around the platen roller 7 and proceed in a clockwise direction, whereas on the previous occasion the scanner/printer head 8 read out the image of the reverse surface of the paper S.

The paper S then proceeds so as to be sandwiched by the first pinch roller R2 rotated in the anti-clockwise direction and the platen roller 7 so as to proceed to the space formed by the guide plate 16 and the lower end surface of the guide mechanism 15. During this time, the image of the reverse surface of the paper S is read out by the scanner/printer head 8.

Figure 11:
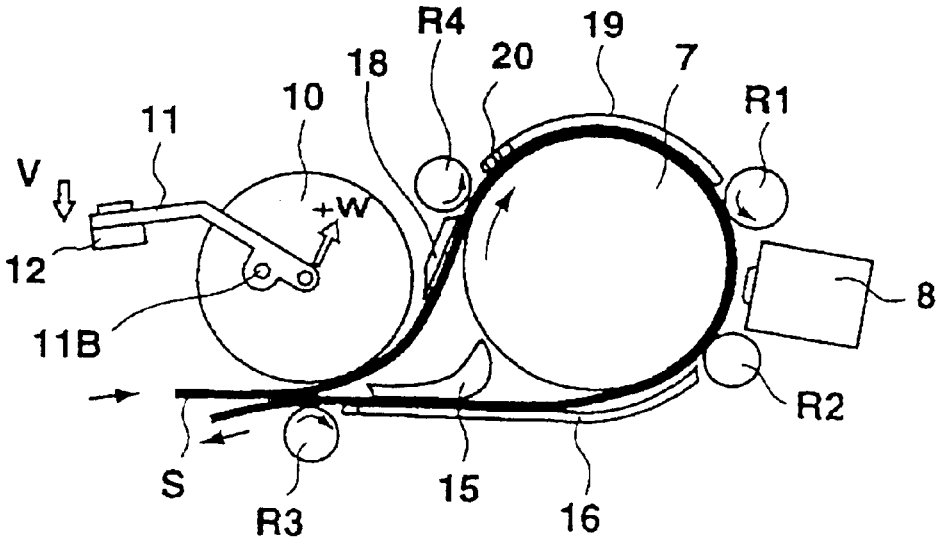
FIG. 11 is a view illustrating the operation of the essential parts of the configuration of the portable image processing device according to the present invention continuing on from FIG. 10.

However, the dimensions of the portable device are small. Therefore, when, for example, the paper S is A4 size, as shown in FIG. 11, portions of paper S that has already been read out for both sides and remaining portions to be read out for just one side become overlaid one on top of another. However, in this case the directions of progress for both sides are opposite to each other but this is not possible as the paper extraction roller 10 and the second pinch roller R3 are separated.

Figure 12:
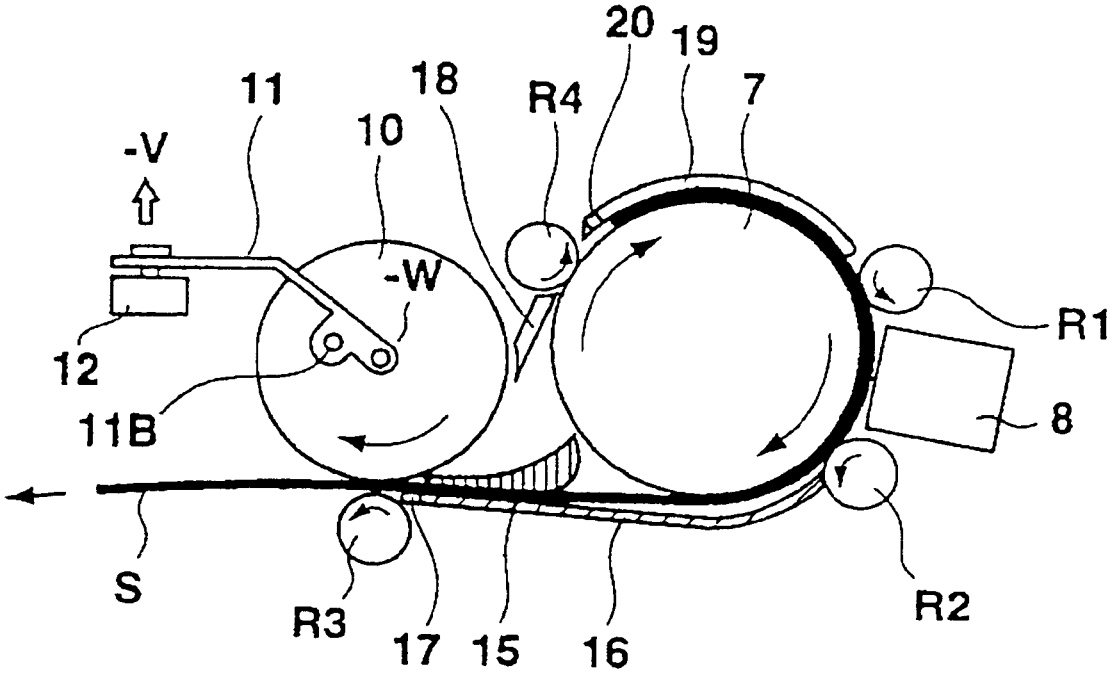
FIG. 12 is a view illustrating the operation of the essential parts of the configuration of the portable image processing device according to the present invention continuing on from FIG. 11.

The reading of images of the reverse side of the paper S is then continued with, and when the following end of the paper S proceeding in the return direction is detected by the second sensor 20 as shown in FIG. 12, this acts as a trigger so that the plunger 12A is driven in the direction shown by −V in FIG. 11 by the solenoid plunger 12. The frame 11 is then made to fluctuate taking the second pin hole 11B as a center and the paper extraction roller 10 is made to move in the direction −W shown in FIG. 11 together with the paper extraction motor 13, with the paper extraction motor 13 also being made to rotate in the clockwise direction at simultaneously.

As a result of this movement the paper extraction roller 10 comes into contact with the second pinch roller R3 as shown in FIG. 11 and the paper S is sandwiched and smoothly and reliably emitted from the device by the rotation of the paper extraction roller 10.

In this way it is possible for the portable image processing device according to the present invention to automatically read out images for both sides of the paper S with the paper S being loaded into the device only once.

Moreover, a structure is adopted where electricity is only supplied to driving portions when necessary, with supplying of electricity being halted promptly at other times so that unnecessary use of electricity is prevented as much as possible. This means that battery savings can be made which is extremely important for portable devices.

Further, in the above a description was given of a configuration where images on both sides of the paper S were automatically read out with just one loading by a scanner head. However, a configuration where both sides of the paper S can be automatically printed with just one loading using a print head is also possible and can be described as above.

When the printer head is a sublimation heat transfer type, settling time to dry printed portions after printing is not required and both sides can therefore be printed at a high speed.

It is, however, necessary to provide an ink ribbon not shown in the drawings with configurations using this kind of sublimation heat transfer type printer heads. Further, it is also preferable to provide paper S for printing with sublimation diffusion layers (reception layers) on both sides.

Alternatively, an ink jet type head can be used as the printer head. In this case, it is preferable to adopt a design where the return start time for the paper S is delayed slightly (i.e. wait time is taken) in order to dry the ink.

Further, it is preferable for the power supply 4 to be capable of both AC and DC operation for use with portable equipment.

Further, as shown in FIG. 1, it is also possible to have a configuration where an auto feeder 42 capable of automatically loading a plurality of sheets of manuscript or a plurality of sheets of printing paper is attached.

Next, the configuration and function of the control part 3 is described.

Figure 13:
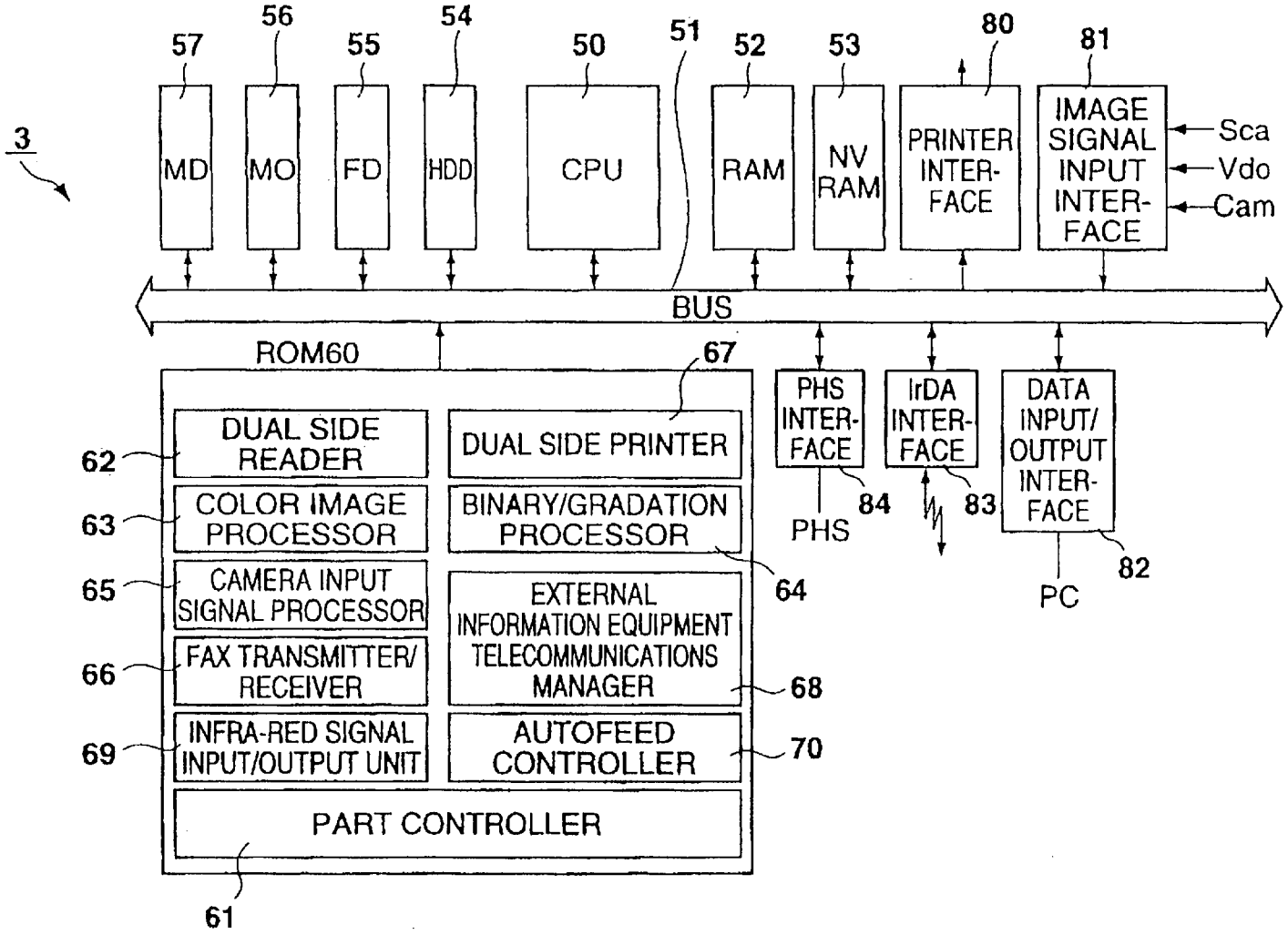
FIG. 13 is a functional block diagram of the control part of the portable image processing device according to the present invention.

As shown in FIG. 13, the control part 3 comprises a microcomputer, where a Central Processing Unit (hereinafter referred to as "CPU") 50, Random Access Memory (hereinafter referred to as "RAM") 52, Non-Volatile Random Access Memory (hereinafter referred to as "NVRAM") 53, hard disc drive (hereinafter referred to as "HDD") 54, Floppy Disc Drive (hereinafter referred to as "FDD") 55, Read Only Memory (hereinafter referred to as "ROM") 60, printer interface 80 and image signal input interface 81 are connected together via a common bus 51.

The printer interface 80 is for printer unit connection use. Further, the image signal input interface 81 is inputted with a scan signal Sca from a scanner, a video signal Vdo from VTR or laser equipment, or a signal Cam from a two-dimensional sensor such as a video camera or a digital camera. Video input/output or camera input/output is possible with this kind of configuration.

Moreover, a configuration where a magneto-optical disc device 56 or a minidisc (trademark) device 57 is connected to the common bus 51 as a recording device is also possible, as is the connection of a Digital Audio Tape (DAT), a Compact Disc Read Only Memory (CD-ROM), Digital Versatile Disc (DVD) or Digital Versatile Disc Random Access Memory (DVD-RAM).

In this case, in addition to building the magneto-optical disc device 56 or the minidisc (trademark) device 57 etc. into a tube, a configuration where these devices are externally attached can also be considered.

Further, it is also possible to provide a data input/output interface 82 capable of being connected to information equipment such as personal computers. According to this configuration, station use of the printer/scanner would be possible in combination with a personal computer with a modem attached.

Moreover, for example, an infra-red communication interface 83 can also be provided to enable wireless connection with other information equipment.

This device can then be used as a portable FAX machine by connection with, for example, a portable personal computer with a modem via the data input/output interface 82 or the infra-red communication interface 83.

Still further, connection with a telephone line is possible by providing a Personal Handy System (trademark, hereinafter referred to as "PHS") interface 84 capable of being connected with a PHS.

In either case, the ROM 60 stores the means required by the CPU 50 to execute programs.

In addition to the each control means 61 for controlling each part of the device, there exists as stored means dual-side capturing means 62 for processing images in either case, color image processing means 63, binarizing/gradation processing means 64, camera input signal processing means 65, FAX transmitting/receiving means 66 and dual-side printing means 67.

Further, external information equipment communication management means 68, infra-red signal input/output means 69 and auto feed processing means 70 can be stored at the ROM 60.

The dual-side capturing means 62 controls the mechanical parts of the scanner unit for reading images on both sides of a single sheet of a manuscript in one operation and also carries out up/down reversal processing of read data during scanning of, for example, the reverse image up and down in reverse directions and carries out compression processing of the read data regardless of whether the surface is the reverse surface or the top surface.

The color image processing means 63 operates while the signal inputted from the image signal input interface 81 is a color image signal or while the print data outputted form the printer interface 80 is a color image signal and executes various processing including compression processing, thus making it possible to input and output color pictures.

The binarizing/gradation processing means 64 performs binary processing or gradation processing on the input/output signals. Input/output is also possible with this means without inquiries regarding binarization or gradation.

Further, the camera input signal processing means 65 performs format processing etc. on the inputted signal Cam inputted from a video camera or a digital camera via the image signal input interface 81.

The FAX transmitting/receiving means 66 has the function of converting transmitted and received signals into facsimile format and executes each of the various processes for this device to function as a fax device.

On the other hand, the dual-side printing means 67 executes the decipher processing for the compressed print data, controls the mechanical parts of the printer unit for printing on both sides of a single sheet of paper in a single operation, and the up and down reverse processing of the print data during printing of, for example, the reverse print image in up and down reverse directions.

The external information equipment communication management means 68 performs processing during the exchange of data and communications with external personal computers or PHS equipment via the data input/output interface 82 or the PHS interface 84.

The infra-red signal input/output means 69 puts the infra-red communication interface 83 under software control and is capable of making cordless connections with each of the various items of external equipment. The auto feed processing means 70 is a program for controlling the auto feed mechanism for automatically feeding paper.

Second Embodiment

Figure 14:
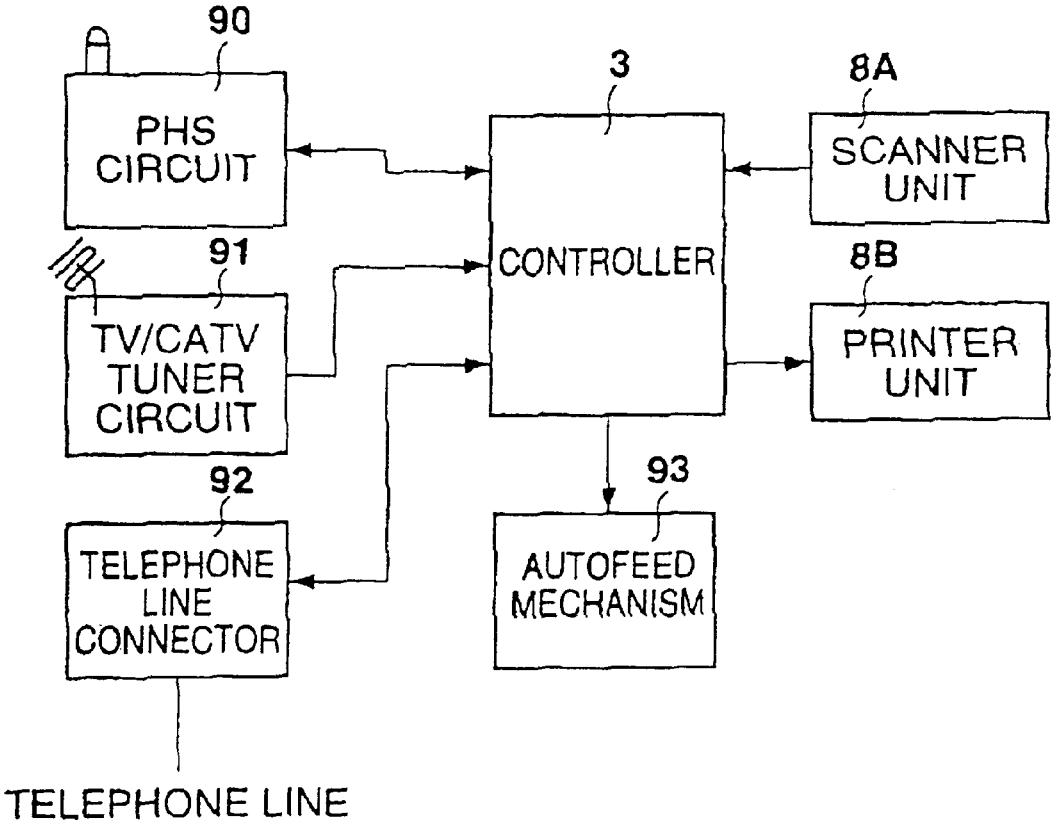
FIG. 14 is a block diagram showing the configuration of a further embodiment of the portable image processing device according to the present invention.

FIG. 14 is a block diagram of the essential parts of a further embodiment of the portable image processing device according to the present invention, showing an example of the configuration of the functional parts controlled by the control part 3. In the example configuration shown in FIG. 14, a scanner unit 8A, printer unit 8B and auto feed mechanism 93 are added, a PHS circuit 90 for executing a PHS function is built-in and a TV/CATV tuner 91 and telephone line connection 92 are provided.

The portable image processing device according to the present invention having the configuration shown in FIG. 14 uses the built-in PHS circuit 90 to function as a PHS device and is capable of cordless telephone communication. Alternatively, this can function as a telephone via the built-in telephone line connection 92 so as to make telephone communication via the telephone line possible.

As a result, print signals from remote locations can be received and a print outputted by the printer unit based on cordless telephone communications or telephone communications via the telephone line or alternatively image signals read-in by the scanner unit can be transmitted to remote locations.

Further, FAX transmission and receival is possible via a cordless line or telephone line by making the FAX transmitting/receiving means 66 operate.

The portable image processing device of the present invention contains a printer and a scanner in a single compact unit, operates on low power consumption using just a single system drive mechanism and is lightweight and portable. It can be used to provide mobile computing using an alternating current/direct current small-type power supply and is capable of performing printing, capturing, copying and fax operations. This means that not only is simultaneous scanning and printing possible together with copying, but also capturing of an image from both surfaces of a piece of paper of printing to both surfaces is possible by loading a manuscript of paper just once which provides both a wide range of applications and great value in many applications.

In order to resolve the aforementioned problems, a portable image processing device according to the present invention comprises at least one read head, at least one platen roller and a guide mechanism for guiding paper in a direction of progression. Here, images on both reverse and front surfaces of loaded paper can be automatically read out with one loading by the front or reverse of the loaded paper coming into contact with the surface of the platen roller rotated in a fixed direction so as to be moved in one direction, an image of the front or reverse of the paper being read out and, after the paper has been temporarily removed from the platen roller due to movement, the paper being returned in the opposite direction so that the front or reverse of the paper again comes into contact with the surface of the platen roller so as to be moved again in the one direction in such a manner that an image on the reverse or the front of the paper is read out. This portable image processing device can then have just one system for the paper feed mechanism, can have fewer parts and can have lower power consumption, and can also be compact and lightweight so as to be more portable and suited to mobile use.

Alternatively, the portable image processing device according to the present invention comprises at least one print head, at least one platen roller and a guide mechanism for guiding paper in a direction of progression. Here, images on both reverse and front surfaces of loaded paper can be automatically printed with one loading by the front or reverse of the loaded paper coming into contact with the surface of the platen roller rotated in a fixed direction so as to be moved in one direction, the front or reverse of the paper being printed on and, after the paper has been temporarily removed from the platen roller due to movement, the paper being returned in the opposite direction so that the front or reverse of the paper again comes into contact with the surface of the platen roller so as to be moved again in the one direction in such a manner that the reverse or the front of the paper is printed on. This portable image processing device can then have just one system for the paper feed mechanism during printing to both sides, can have fewer parts and can have lower power consumption, and can also be compact and lightweight so as to be more portable and suited to mobile use.

Further, the portable image processing device according to the present invention can comprise at least one read head, at least one print head, at least one platen roller and a guide mechanism for guiding paper in a direction of progression. Here, images on both reverse and front surfaces of loaded paper can be automatically read out and/or printed with one loading by the front or reverse of the loaded paper coming into contact with the surface of the platen roller rotated in a fixed direction so as to be moved in one direction, an image of the front or reverse of the paper being read out and/or the front or reverse of the paper being printed on and, after the paper has been temporarily removed from the platen roller due to movement, the paper being returned in the opposite direction so that the front or reverse of the paper again comes into contact with the surface of the platen roller so as to be moved again in the one direction in such a manner that an image on the reverse or the front of the paper is read out and/or the reverse or the front of the paper is printed on. This portable image processing device can then have just one system for the paper feed mechanism, can have fewer parts and can have lower power consumption, and can also be compact and lightweight so as to be more portable and suited to mobile use.

Further, the portable image processing device according to the present invention is provided with a front/reverse capturing means having a function for carrying out up and down or front to back reverse processing on a read-out image, so that read data processing at the time of reading of the front or reverse of a manuscript can be performed in a more effective manner.

Moreover, the portable image processing device according to the present invention is provided with front/reverse printing means having a function for carrying out up and down or front to back reverse processing on a printed image, so that print data processing at the time of printing to the front and reverse of printing paper can be performed in a more efficient manner.

Further, the front/reverse reading means and front/reverse printing means of the portable image processing device according to the present invention are combined, so that data can be processed in a more efficient manner during reading the front and reverse surfaces of a manuscript or during printing to the front and/or reverse sides of paper.

Moreover, the portable image processing device according to the present invention is provided with color image processing means having a color image signal processing function, so that inputting or outputting of color images becomes possible so as to broaden the range of possible applications.

Still further, the portable image processing device according to the present invention is further provided with binarizing/gradation processing means having both binarizing and gradation signal processing functions, so that application to the processing of binary information and the processing of information such as photographs that have a great deal of gradation becomes possible.

Moreover, the portable image processing device according to the present invention is provided with camera input signal processing means for processing image signals from a camera, so that images taken on sight can be directly inputted and processed.

The portable image processing device according to the present invention is further provided with external information equipment communication management means for communicating and exchanging data with external information equipment, so that connection with external equipment is simple and efficient.

Further, the portable image processing device according to the present invention is further provided with infrared signal input/output means capable of cordless connection to external equipment, so that the exchange of data with external equipment in a cordless and efficient manner is possible.

Moreover, the portable image processing device according to the present invention is made to have a PHS circuit built-in, so that exchange of wireless image data is possible in a wireless manner and the range of applications is broadened.

The portable image processing device according to the present invention is further provided with a TV/CATV tuner circuit, so that printing directly from TV/CATV programs is possible, as is dual side printing.

Further, the portable image processing device according to the present invention is further provided with an auto feed mechanism, so that auto-feeding of manuscripts or paper is possible.

What is claimed is:

1. A portable image-processing apparatus for processing an image on one or both sides of a planar sheet, comprising:

a cylindrical platen and cooperating first pinch roller and cooperating second pinch roller for transporting a planar sheet having first and second surfaces and first and second ends past an image-processing device to present a one of said surfaces of said sheet to said image-processing device for processing thereby as said one of said surfaces is transported past said image-processing device, said platen and first and second pinch rollers moving said sheet in a direction past said image-processing device such that said first end of said sheet is initially transported past said image-processing device and said second end is thereafter transported past said image-processing device;

a selectively adjustable paper-directing guide for guiding a sheet moving in a first direction along a first path away from said platen and for guiding a sheet moving in a second direction along a second path toward said platen to transfer said sheet thereto;

said platen and first and second pinch rollers moving a sheet toward said paper-directing guide for guided movement in the first direction along said first path after the second end of said sheet is transported past said image-processing device;

a bi-directional sheet-driving roller for receiving a sheet guided along said first path in a first direction by said paper-directing guide and thereafter reversing the direction of movement of said sheet to drive said sheet in the second direction along said second path for transfer to said platen; and a third pinch roller cooperating with said platen to accept a sheet driven in the second direction along said second path to transport said sheet to said first and second pinch rollers to transport said sheet past said image-processing device to present the other of the surfaces of said sheet to said image-processing device for processing thereby;

said bi-directional sheet-driving roller selectively engageable and disengagable with said sheet, said bi-directional sheet-driving roller in engagement with said sheet when driving said sheet in either of said first or said second direction and disengaged therefrom when not driving said sheet.

2. The portable image processing apparatus of claim 1, further comprising color image processing means having a color image signal processing function.

3. The portable image processing apparatus of claim 1, further comprising binarizing/gradation processing means having both binarizing and gradation signal processing functions.

4. The portable image processing apparatus of claim 1, further comprising camera input signal processing means for processing image signals from a camera.

5. The portable image processing apparatus of claim 1, further comprising external information equipment communication management means for communicating and exchanging data with external information equipment.

6. The portable image processing apparatus of claim 1, further comprising infrared signal input/output means capable of cordless connection to external equipment.

7. The portable image processing apparatus of claim 1, having a PHS circuit built-in.

8. The portable image processing apparatus of claim 1, further comprising a TV/CATV tuner circuit.

9. The portable image processing apparatus of claim 1, further comprising an auto feed mechanism.

10. The portable image-processing apparatus of claim 1, wherein said image-processing device comprises a read head for reading an image from said sheet.

11. The portable image processing apparatus of claim 10, further comprising front/reverse side reading means having a function for carrying out up and down or front to back reverse processing on a read-out image.

12. The portable image-processing apparatus of claim 1, wherein said image-processing device comprises a print head for printing an image upon said sheet.

13. The portable image processing apparatus of claim 12, further comprising front/reverse printing means having a function for carrying out up and down or front to back reverse processing on a printed image.

14. The portable image-processing apparatus of claim 1, wherein said image-processing device comprises a print head for printing an image upon said sheet a read head for reading an image from said sheet.

15. The portable image-processing apparatus of claim 1, wherein said bi-directional sheet-driving roller is rotatably mounted on a support frame, said support frame selectively actuatable to move said bi-directional sheet-driving roller into and out of engagement with said sheet.

16. The portable image-processing apparatus of claim 15, further comprising an electrically actuated solenoid connected to said support frame and selectively actuatable to move said bi-directional sheet-driving roller into and out of engagement with said sheet.

* * * * *